US012402735B1

(12) United States Patent
Webber

(10) Patent No.: US 12,402,735 B1
(45) Date of Patent: Sep. 2, 2025

(54) ILLUMINATED GRADED CARD SLAB HOLDER

(71) Applicant: Brett Wayne Webber, Gulfport, MS (US)

(72) Inventor: Brett Wayne Webber, Gulfport, MS (US)

( * ) Notice: Subject to any disclaimer, the term of this patent is extended or adjusted under 35 U.S.C. 154(b) by 0 days.

(21) Appl. No.: 18/903,048

(22) Filed: Oct. 1, 2024

(51) Int. Cl.
*A47F 11/10* (2006.01)
*A45C 11/18* (2006.01)

(52) U.S. Cl.
CPC ..... *A47F 11/10* (2013.01); *A45C 11/18* (2013.01)

(58) Field of Classification Search
CPC ..... A47F 11/10; A47G 2001/147; A47G 1/14; G09F 1/10; G09F 1/12
USPC ..... 362/97.4, 125; 40/124.02, 124.06, 661, 40/661.02
See application file for complete search history.

(56) References Cited

U.S. PATENT DOCUMENTS 4,979,619 A * 12/1990 Hager ..... G09F 23/0066 150/147
5,097,953 A * 3/1992 Gingras ..... G09F 1/10 206/39
5,407,204 A 4/1995 Meyer, III
5,421,583 A 6/1995 Gluck
5,522,163 A * 6/1996 Neugebauer ..... G09F 3/20 40/661
5,570,275 A 10/1996 Luquire
5,782,023 A 7/1998 Iannantuano et al.
6,827,209 B1 * 12/2004 Tank ..... B42D 15/00 206/459.5
D971,338 S 11/2022 Spiegel
2009/0109701 A1 4/2009 Hsieh
2023/0284760 A1 9/2023 Shooltz

FOREIGN PATENT DOCUMENTS

WO 1998019106 5/1998

* cited by examiner

*Primary Examiner* — Thomas M Sember
(74) *Attorney, Agent, or Firm* — Kyle A. Fletcher, Esq.

(57) ABSTRACT

The illuminated graded card slab holder may include a slab and an illumination subsystem. The slab may hold and encapsulate a graded card. The slab may protect the graded card from damage. The slab may comprise two display windows to provide visibility to the graded card and a frame surrounding the two display windows to strengthen the slab. The illumination subsystem may provide illumination of at least one side of the graded card that is encapsulated within the slab. As non-limiting examples, the graded card may be a trading card such as a sports card depicting a baseball or football player, a collectible card depicting a movie or video game character, or a game card which may be used as a game piece in a fantasy or role-playing game.

20 Claims, 5 Drawing Sheets

ILLUMINATED GRADED CARD SLAB HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of containers for graded cards and illuminated display cases, more specifically, an illuminated graded card slab holder.

SUMMARY OF INVENTION

The illuminated graded card slab holder may comprise a slab and an illumination subsystem. The slab may hold and encapsulate a graded card. The slab may protect the graded card from damage. The slab may comprise two display windows to provide visibility to the graded card and a frame surrounding the two display windows to strengthen the slab. The illumination subsystem May provide illumination of at least one side of the graded card that is encapsulated within the slab. As non-limiting examples, the graded card may be a trading card such as a sports card depicting a baseball or football player, a collectible card depicting a movie or video game character, or a game card which may be used as a game piece in a fantasy or role-playing game.

An object of the invention is to provide a slab that may encapsulate a graded card in order to protect the graded card.

Another object of the invention is to provide two display windows that are clear in order to view the graded card while the graded card is held within the slab.

A further object of the invention is to provide an illumination system that may be energized to illuminate at least one side of the graded card while the graded card is held within the slab.

Yet another object of the invention is to provide a plurality of front LEDs and a plurality of rear LEDs such that both sides of the graded card may be illuminated by the illumination system.

These together with additional objects, features and advantages of the illuminated graded card slab holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated graded card slab holder in detail, it is to be understood that the illuminated graded card slab holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated graded card slab holder.

It is therefore important that the claims be regarded as including such equivalent construction insofar as they do not depart from the spirit and scope of the illuminated graded card slab holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
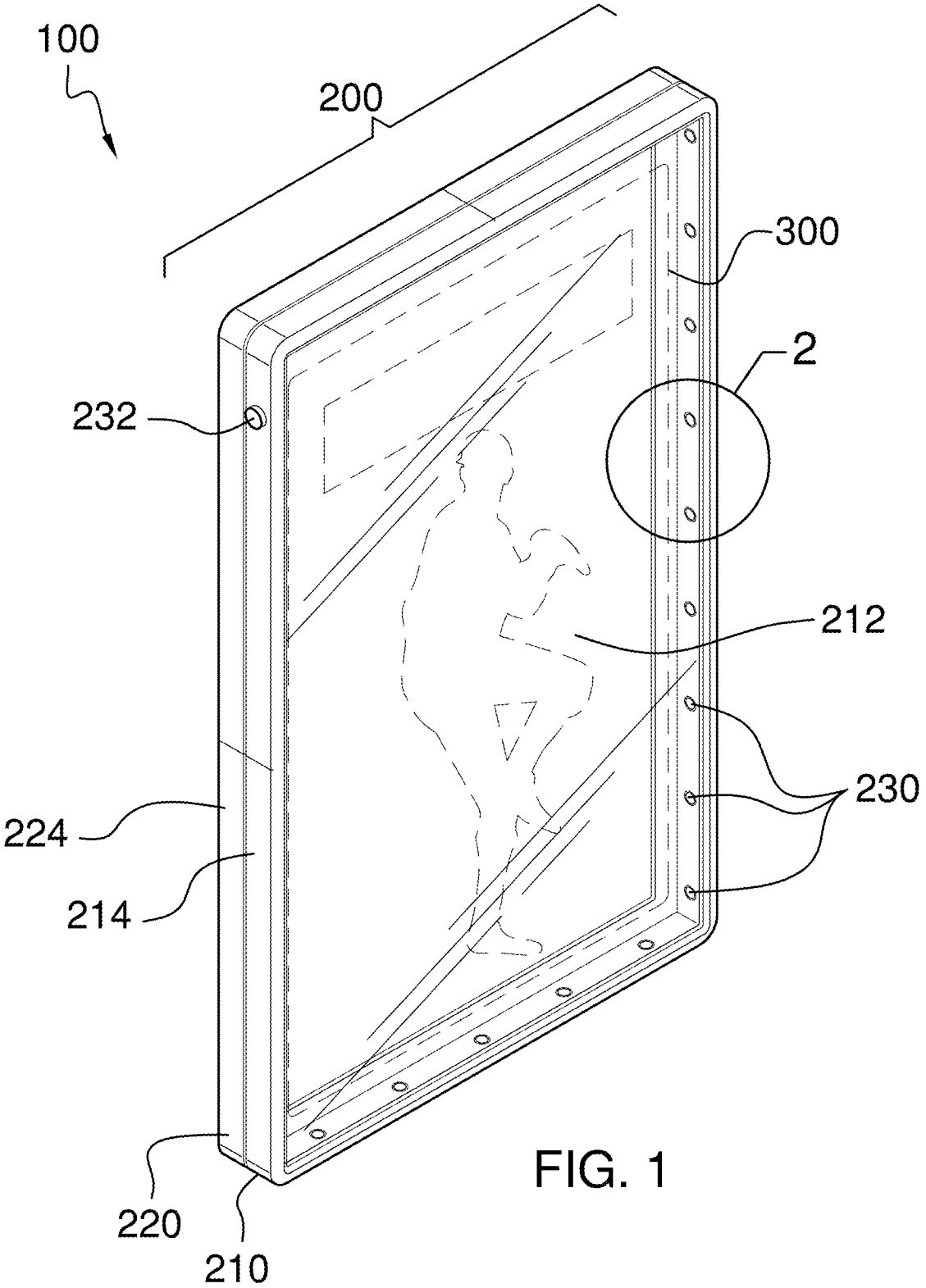
FIG. 1 is an isometric view of an embodiment of the disclosure.
Figure 2:
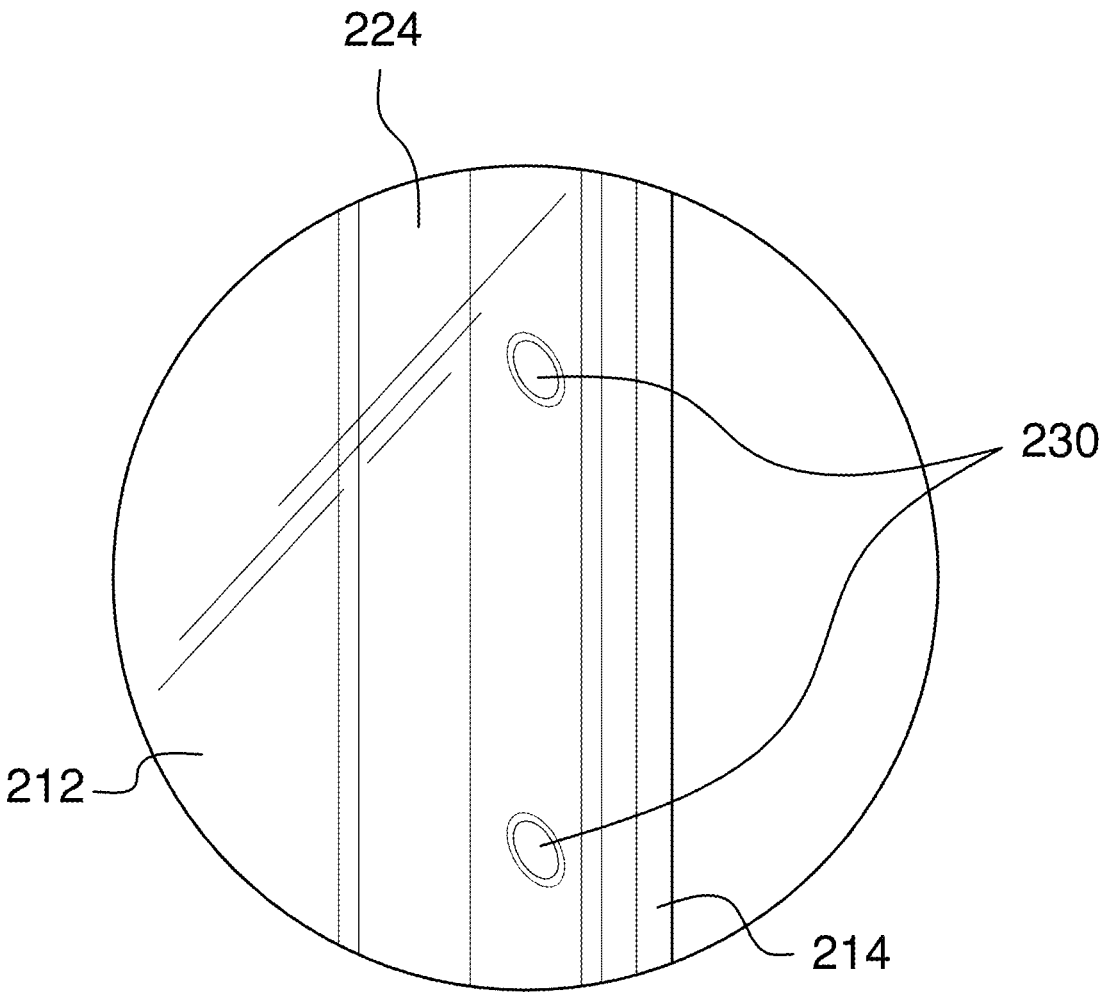
FIG. 2 is a detail view of an embodiment of the disclosure, illustrating the plurality of front LEDs.
Figure 3:
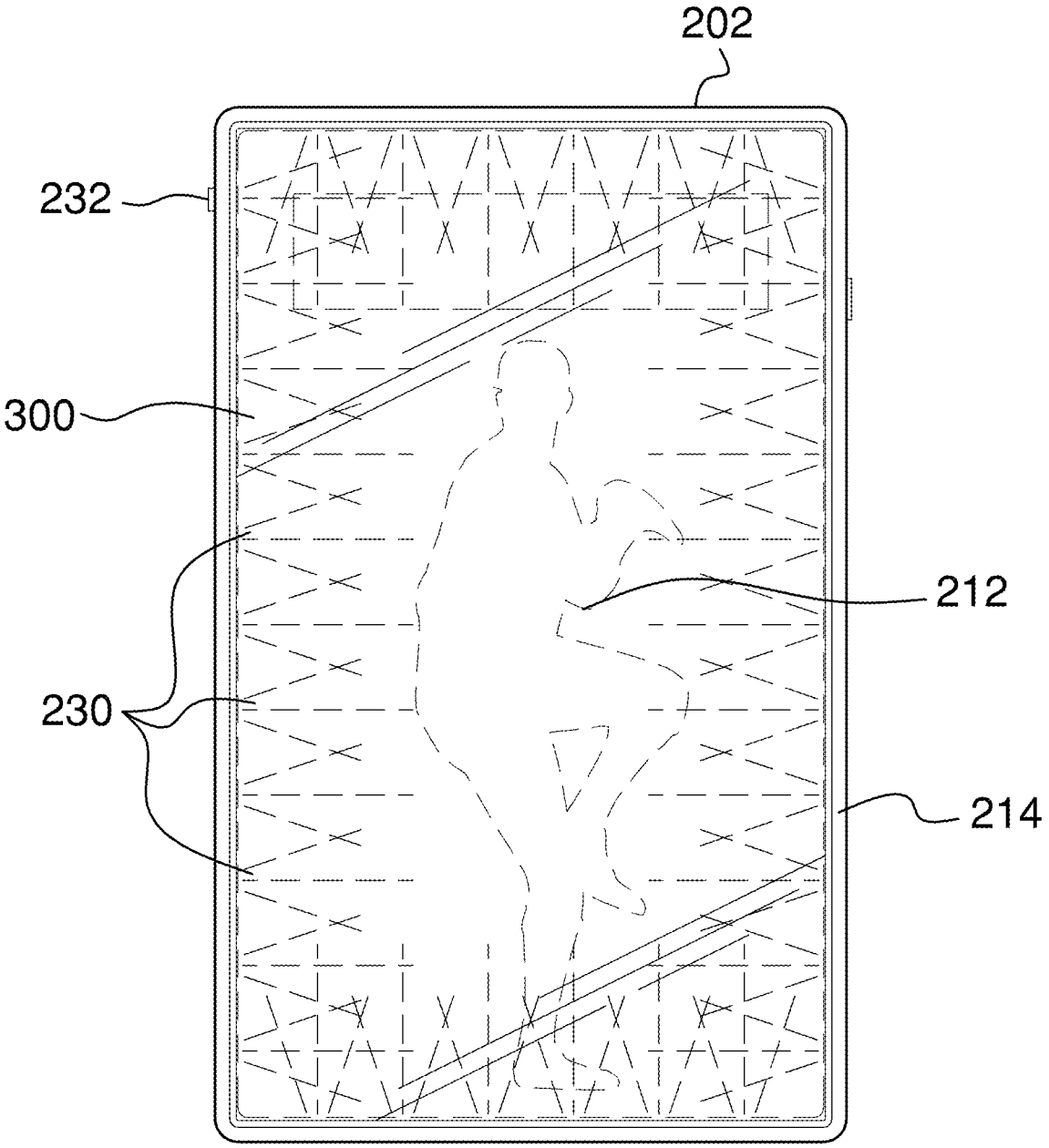
FIG. 3 is a front view of an embodiment of the disclosure.
Figure 4:
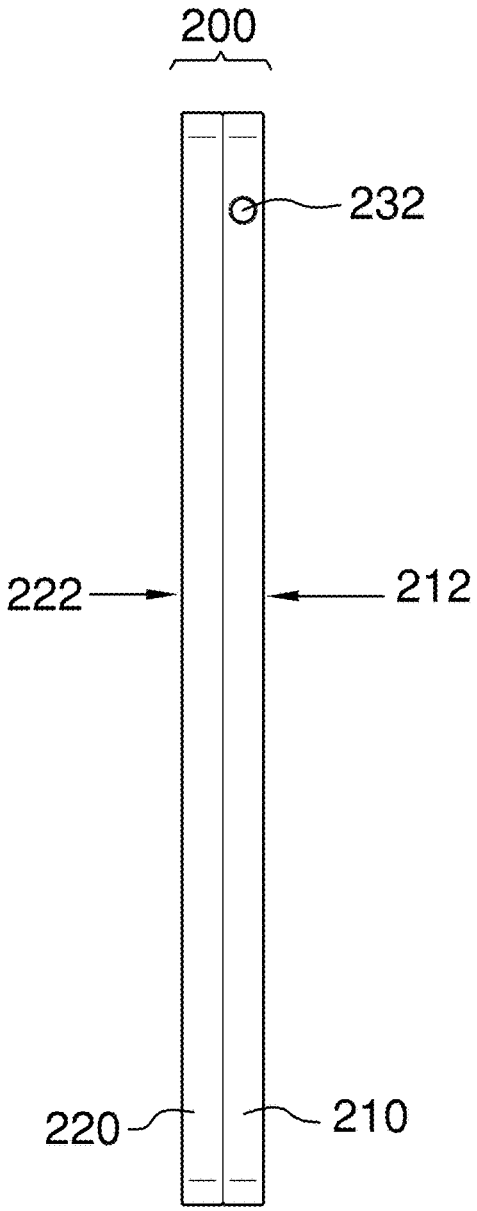
FIG. 4 is a left side view of an embodiment of the disclosure.
Figure 5:
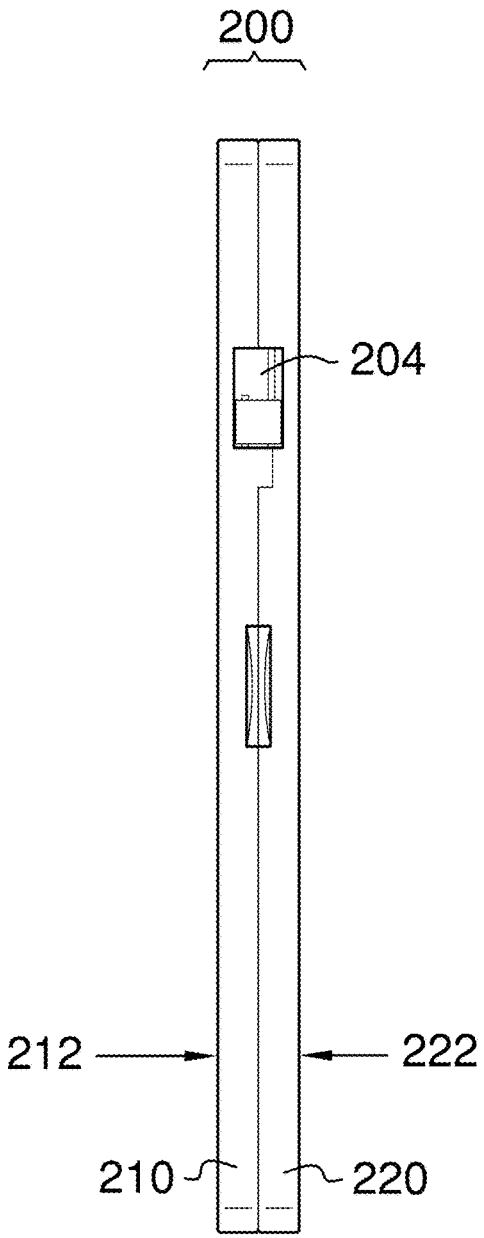
FIG. 5 is a right side view of an embodiment of the disclosure.
Figure 6:
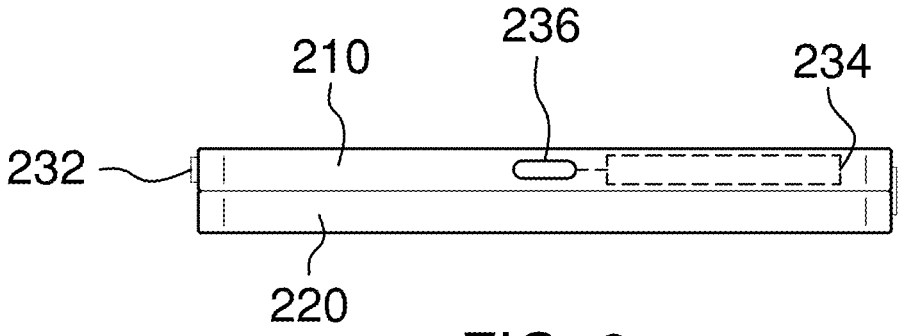
FIG. 6 is a bottom view of an embodiment of the disclosure.
Figure 7:
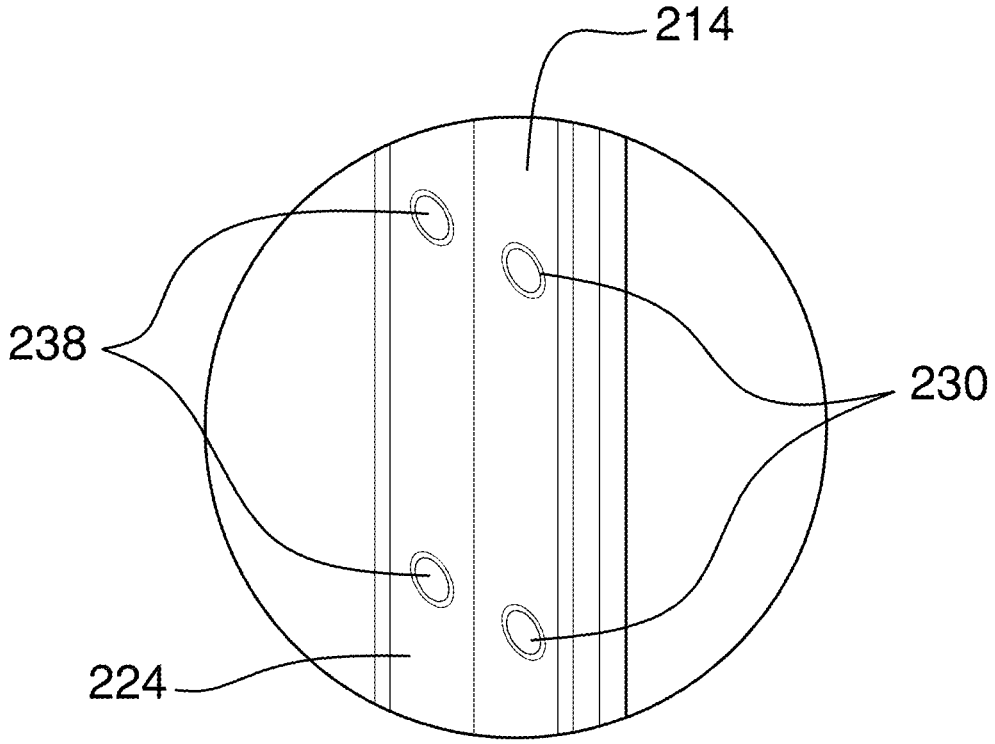
FIG. 7 is an isometric view of an alternative embodiment of the disclosure, illustrating both a plurality of front LEDS and a plurality of rear LEDs.

Detailed reference will now be made to a first potential embodiment of the disclosure, which is illustrated in FIGS. 1 through 7.

The illuminated graded card slab holder 100 (hereinafter invention) comprises a slab and an illumination subsystem. The slab 200 may hold and encapsulate a graded card 300. The slab 200 may protect the graded card 300 from damage. The slab 200 may comprise two display windows to provide visibility to the graded card 300 and a frame 202 surrounding the two display windows to strengthen the slab 200. The illumination subsystem may provide illumination of at least one side of the graded card 300 that is encapsulated within the slab 200. As non-limiting examples, the graded card 300 may be a trading card such as a sports card depicting a baseball or football player, a collectible card depicting a movie or video game character, or a game card which may be used as a game piece in a fantasy or role-playing game.

The slab 200 may comprise a slab front half 210 and a slab rear half 220. The slab front half 210 may comprise a front display window 212 and the slab rear half 220 may comprise a rear display window 222. The slab front half 210 and the slab rear half 220 may be coupled to each other to encapsulate the graded card 300 within a cavity located between the front display window 212 and the rear display window 222. In some embodiments, the frame 202 may comprise a lock 204 to prevent the slab 200 from being opened.

The slab front half 210 may comprise a front frame half 214 surrounding the front display window 212 and the slab rear half 220 may comprise a rear frame half 224 surrounding the rear display window 222. The slab front half 210 and the slab rear half 220 may separate to exposed the cavity for placing the graded card 300 into the slab 200.

In some embodiments, the slab front half 210 and the slab rear half 220 may be two independent components that may be separated in order to open the slab 200. The slab front half 210 and the slab rear half 220 may be aligned and pressed together in order to close the slab 200.

In some embodiments, the slab front half 210 and the slab rear half 220 may be hingedly coupled and the slab front half 210 may pivot relative to the slab rear half 220 in order to open and close the slab 200.

The illumination subsystem may comprise a plurality of LEDs, an ON/OFF switch 232, and a battery 234. The illumination subsystem may illuminate the graded card 300 within the slab 200 to improve viewing of the graded card 300. The plurality of LEDs may be located within the frame 202 of the slab 200 and may be oriented to point towards the graded card 300. The ON/OFF switch 232 and the battery 234 may be located within the frame 202 and positioned such that the ON/OFF switch 232 and/or the battery 234 are accessible from outside of the slab 200. The ON/OFF switch 232 may be adapted for a user to energize and deenergize the plurality of LEDs by completing and breaking an electrical circuit between the plurality of LEDs and the battery 234. The battery 234 may comprise one or more energy-storage devices. The battery may be a source of electrical energy to operate the plurality of LEDs. The battery 234 may be rechargeable and/or replaceable.

The plurality of LEDs may comprise a plurality of front LEDs 230. The plurality of front LEDs 230 may be coupled to the inside of the front frame half 214, adjacent to the front display window 212. The plurality of front LEDs 230 may illuminate the front side of the graded card 300.

In some embodiments, the battery 234 may be coupled to a charging port 236 that may be accessible from outside of the slab 200. The charging port 236 may be coupled to an external charging adapter in order to recharge the battery 234.

In some embodiments, the plurality of LEDs may comprise a plurality of rear LEDs 238. The plurality of rear LEDs 238 may be coupled to the inside of the rear frame half 224, adjacent to the rear display window 222. The plurality of rear LEDs 238 may illuminate the rear side of the graded card 300.

Together, the plurality of front LEDs 230 and the plurality of rear LEDs 238 may illuminate both sides of the graded card 300.

In some embodiments, the slab 200 may comprise a grading area. The grading area may be an upward extension of the frame 202 where a grading information regarding the graded card 300 may be displayed. As a non-limiting example, the grading information may comprise a numerical grade and may identify the organization that performed the grading.

As a non-limiting example, the slab 200 may be made of acrylic plastic. In some embodiments, the two display windows may be UV opaque in order to protect the graded card from damage by exposure to sunlight and/or other light sources.

In use, the graded card 300 may be place between the slab front half 210 and the slab rear half 220. The slab 200 may be closed by positioning the slab front half 210 adjacent to the slab rear half 220 and by pressing the slab front half 210 against the slab rear half 220 to seal the slab 200. In some embodiments, the slab front half 210 may pivot on a hinge to close against the slab rear half 220. In some embodiments, a lock 204 may be actuated to prevent the slab 200 from opening. The graded card 300 may be visible through the front display window 212 and the rear display window 222.

The user may activate the illumination subsystem to illuminate the graded card 300 for improved visibility. The illumination subsystem may be activated by actuating the ON/OFF switch 232 accessible on the exterior of the frame 202. Activating the illumination subsystem may energize the plurality of front LEDs 230 to illuminate the front of the graded card 300. In some embodiments, the illumination subsystem may also energize the plurality of rear LEDs to illuminate the rear side of the graded card 300. The user may extinguish the plurality of LEDs by actuating the ON/OFF switch 232 a second time.

Definitions

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "cavity" may be an empty space or negative space that is formed within an object.

As used herein, the words "couple", "couples", "coupled" or "coupling", may refer to connecting, either directly or indirectly, and does not necessarily imply a mechanical connection.

As used herein, the words "data" and "information" may be used interchangeably to refer to raw, unprocessed facts and to facts that have been processed, structured, organized, or presented in a context that makes the facts useful.

As used herein, "energize" and/or "energization" may refer to the application of an electrical potential to a system or subsystem. "De-energize" and/or "de-energization" may refer to the removal of the electrical potential.

As used in this disclosure, the word "exterior" may be used as a relational term that implies that an object is not located or contained within the boundary of a structure or a space.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "hinge" may be a device that permits the turning, rotating, or pivoting of a first object relative to a second object.

As used in this disclosure, "opaque" may refer to an object or material that prevents the passage of light and/or other forms of radiations through the object or material.

As used herein, the word "pivot" may include any mechanical arrangement that allows for rotational motion. Non-limiting examples of pivots may include hinges, holes, posts, dowels, pins, points, rods, rivets, shafts, balls, and sockets, either individually or in combination.

As used herein, "such as" may introduce one or more non-limiting examples.

As used in this disclosure, a "switch" may be an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

As used herein, "trading card" refer to a small paperback card containing an image of a person, place, or thing (real or fictional) along with a description of the subject of the trading card. "Graded card" may refer to a trading card that has been appraised and encapsulated. The grade may be determined based upon the condition, scarcity, and popularity of the trading card. An encapsulated, graded card may be said to 'slabbed', referring to the clear plastic container that the card is packaged in.

As used in this disclosure, "UV" may be an abbreviation for ultraviolet.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An illuminated graded card slab holder comprising:

a slab and an illumination subsystem;

wherein the slab is configured to hold and encapsulate a graded card;

wherein the slab is configured to protect the graded card from damage;

wherein the slab comprises two display windows that is configured to provide visibility to the graded card and a frame surrounding the two display windows to strengthen the slab;

wherein the illumination subsystem is configured to provide illumination of at least one side of the graded card that is encapsulated within the slab.

2. The illuminated graded card slab holder according to claim 1 wherein the slab comprises a slab front half and a slab rear half;

wherein the slab front half comprises a front display window and the slab rear half comprise a rear display window;

wherein the slab front half and the slab rear half are coupled to each other to encapsulate the graded card within a cavity located between the front display window and the rear display window.

3. The illuminated graded card slab holder according to claim 2 wherein the frame comprises a lock to prevent the slab from being opened.

4. The illuminated graded card slab holder according to claim 2 wherein the slab front half comprises a front frame half surrounding the front display window and the slab rear half comprises a rear frame half surrounding the rear display window.

5. The illuminated graded card slab holder according to claim 4 wherein the slab front half and the slab rear half separate to exposed the cavity for placing the graded card into the slab.

6. The illuminated graded card slab holder according to claim 5 wherein the slab front half and the slab rear half are two independent components that are separated in order to open the slab;

wherein the slab front half and the slab rear half are aligned and pressed together in order to close the slab.

7. The illuminated graded card slab holder according to claim 5 wherein the slab front half and the slab rear half are hingedly coupled and the slab front half pivots relative to the slab rear half in order to open and close the slab.

8. The illuminated graded card slab holder according to claim 5 wherein the illumination subsystem comprises a plurality of LEDs, an ON/OFF switch, and a battery;

wherein the illumination subsystem illuminates the graded card within the slab to improve viewing of the graded card.

9. The illuminated graded card slab holder according to claim 8 wherein the plurality of LEDs are located within the frame of the slab and are oriented to point towards the graded card.

10. The illuminated graded card slab holder according to claim 9 wherein the ON/OFF switch and the battery are located within the frame and positioned such that the ON/OFF switch and/or the battery are accessible from outside of the slab.

11. The illuminated graded card slab holder according to claim 10 wherein the ON/OFF switch is adapted for a user to energize and deenergize the plurality of LEDs by completing and breaking an electrical circuit between the plurality of LEDs and the battery.

12. The illuminated graded card slab holder according to claim 11 wherein the battery comprises one or more energy-storage devices;

wherein the battery is a source of electrical energy to operate the plurality of LEDS;

wherein the battery is rechargeable and/or replaceable.

13. The illuminated graded card slab holder according to claim 12 wherein the plurality of LEDs comprise a plurality of front LEDS;

wherein the plurality of front LEDs are coupled to the inside of the front frame half, adjacent to the front display window;

wherein the plurality of front LEDs illuminate the front side of the graded card.

14. The illuminated graded card slab holder according to claim 13 wherein the battery is coupled to a charging port that is accessible from outside of the slab;

wherein the charging port is coupled to an external charging adapter in order to recharge the battery.

15. The illuminated graded card slab holder according to claim 13 wherein the plurality of LEDs comprise a plurality of rear LEDS;

wherein the plurality of rear LEDs are coupled to the inside of the rear frame half, adjacent to the rear display window;

wherein the plurality of rear LEDs illuminate the rear side of the graded card.

16. The illuminated graded card slab holder according to claim 15 wherein the plurality of front LEDs and the plurality of rear LEDs illuminate both sides of the graded card.

17. The illuminated graded card slab holder according to claim 13 wherein the slab comprises a grading area;

wherein the grading area is an upward extension of the frame where a grading information regarding the graded card is displayed.

18. The illuminated graded card slab holder according to claim 17 wherein the grading information comprises a numerical grade and identifies the organization that performed the grading.

19. The illuminated graded card slab holder according to claim 13 wherein the slab is made of acrylic plastic.

20. The illuminated graded card slab holder according to claim 19 wherein the two display windows are UV opaque in order to protect the graded card from damage by exposure to sunlight and/or other light sources.

* * * * *